US008167591B1

(12) United States Patent
Sorensen

(10) Patent No.: US 8,167,591 B1
(45) Date of Patent: May 1, 2012

(54) HIGH PRESSURE AIR PUMP WITH RECIPROCATING DRIVE

(76) Inventor: Duane A. Sorensen, Cleburne, TX (US)

( * ) Notice: Subject to any disclaimer, the term of this patent is extended or adjusted under 35 U.S.C. 154(b) by 207 days.

(21) Appl. No.: 12/795,865

(22) Filed: Jun. 8, 2010

Related U.S. Application Data

(63) Continuation-in-part of application No. 12/122,882, filed on May 19, 2008, now Pat. No. 8,047,818.

(51) Int. Cl.
*F04B 25/04* (2006.01)
*F04B 37/12* (2006.01)

(52) U.S. Cl. ..... 417/469; 417/258; 417/521; 417/410.1

(58) Field of Classification Search ..... 417/254, 417/258, 469, 517, 544, 518, 521, 410.1
See application file for complete search history.

(56) References Cited

U.S. PATENT DOCUMENTS

| | | | | |
|---|---|---|---|---|
| 817,538 | A * | 4/1906 | Wixon | 417/258 |
| 882,215 | A * | 3/1908 | Stapley | 417/254 |
| 1,187,835 | A * | 6/1916 | Hill | 417/248 |
| 1,332,995 | A * | 3/1920 | Nolda | 417/569 |
| 1,978,866 | A | 2/1933 | Konig | |
| 3,257,960 | A * | 6/1966 | Keel | 417/269 |
| 3,650,639 | A * | 3/1972 | Greene et al. | 417/368 |
| 4,085,711 | A | 4/1978 | Braun | |
| 4,276,003 | A * | 6/1981 | Perkins et al. | 417/415 |
| 4,832,578 | A * | 5/1989 | Putt | 417/266 |
| 5,525,044 | A * | 6/1996 | Chen | 417/262 |
| 5,681,154 | A * | 10/1997 | Yang | 417/512 |
| 5,885,061 | A | 3/1999 | Olofsson et al. | |
| 6,015,270 | A | 1/2000 | Roth | |
| 6,139,288 | A * | 10/2000 | Karasawa | 417/415 |
| 6,190,142 | B1 * | 2/2001 | Wu | 417/523 |
| 6,371,741 | B1 * | 4/2002 | Wu | 417/446 |
| 6,702,556 | B2 * | 3/2004 | Axelsson | 417/523 |
| 7,052,250 | B2 * | 5/2006 | Miura et al. | 417/313 |
| 7,104,276 | B2 * | 9/2006 | Einhaus | 137/512 |
| 7,410,348 | B2 * | 8/2008 | Chalk et al. | 417/555.1 |
| 7,607,898 | B2 * | 10/2009 | Noble et al. | 417/437 |

FOREIGN PATENT DOCUMENTS

WO PCT/2002/005570 B1 1/2002

* cited by examiner

*Primary Examiner* — Devon C Kramer
*Assistant Examiner* — Nathan Zollinger
(74) *Attorney, Agent, or Firm* — Dan Brown Law Office; Daniel R. Brown

(57) ABSTRACT

A reciprocating air pump with a frame and a pump for compressing air through a series of linear close-strokes and open-strokes between a first portion and a reciprocating portion. The pump includes plural cylinders, slideably and sealably engaged therein, and arranged as multiple-chambers defining multiple-stages, for compression of air. A manifold with an air inlet cavity and inlet vent, and a compressed air outlet cavity with outlet vent. An outlet valve body is disposed between the first portion and the manifold, with an outlet valve that directs high-pressure compressed air into the outlet cavity, and with an inlet port coupled to the inlet cavity. A reciprocating linear drive with an electric motor delivers linear force to the reciprocating portion. A control system sequentially alternated the direction of force of the reciprocating linear drive, thereby applying linear force to the reciprocating portion.

18 Claims, 8 Drawing Sheets

Fig. 5
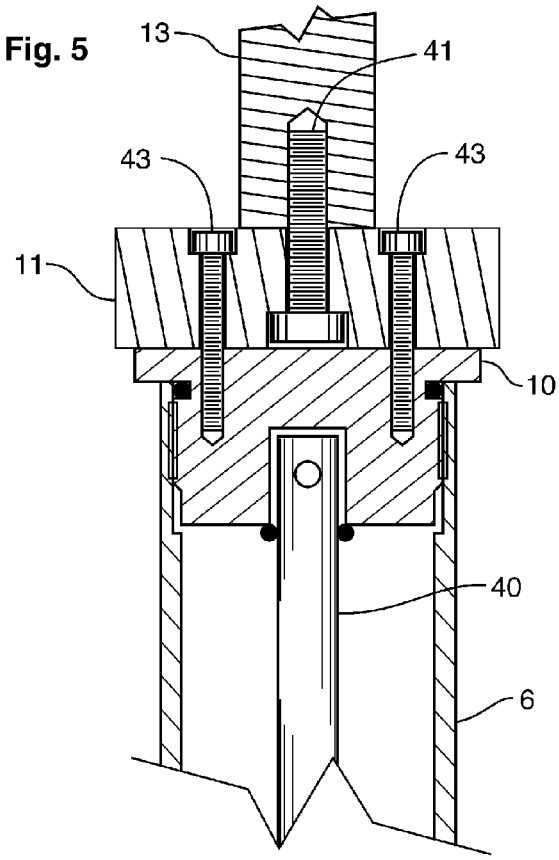
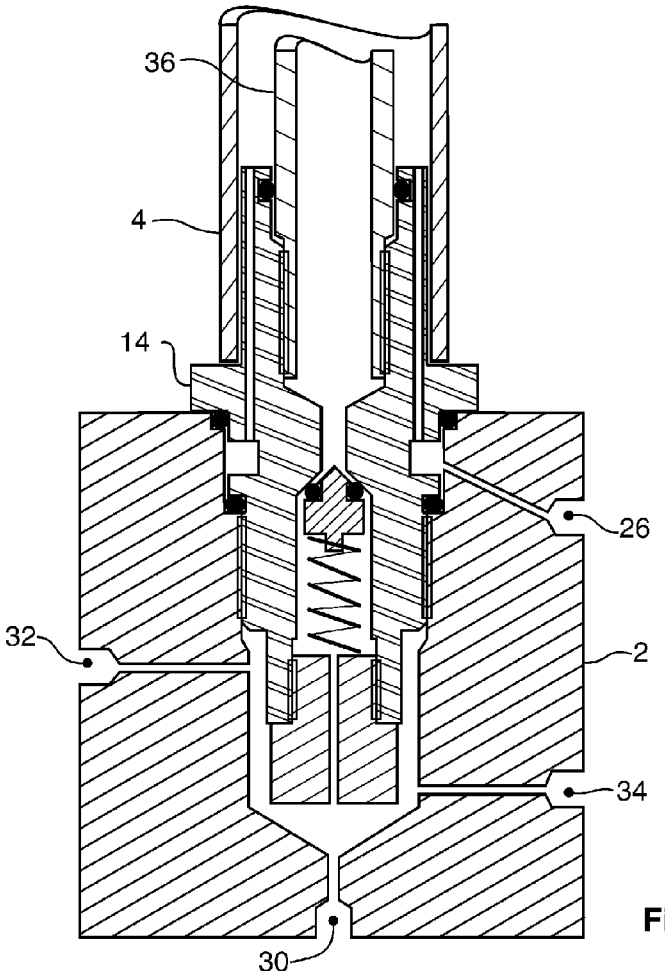
Fig. 4

Initial Intake
Open-Stroke

Secondary
Compression
Open-Stroke

Final
Compression
Close-Stroke

HIGH PRESSURE AIR PUMP WITH RECIPROCATING DRIVE

BACKGROUND OF THE INVENTION

1. Field of the Invention

The present invention relates to air pumps. More specifically, the present invention relates to electrically driven, multi-stage, high-pressure, reciprocating air pumps.

2. Description of the Related Art

Simple hand operated reciprocal air pumps, such as bicycle tire pumps, have been available for several decades. A cylinder and piston within the pump provide a single-action compression system that generally dawns in ambient air on the up-stroke and then compresses the air on the down-stroke. Check valves are employed on the inlet and compressed air outlet of the pump, such that a series of reciprocal stokes can be employed to gradually build up the air pressure at the outlet, which may be connected to a pneumatic tire, a storage tank, or other air-receiving container. The compression ratio of the pump limits the maximum pressure that can be developed, which is approached asymptotically. The maximum compression ratio is dictated by the displacement ratio between the volume of the fully open cylinder on the upstroke and the fully closed cylinder on the down-stroke. More efficient versions of such pumps may be configured to compress air on both the up-stroke and the down-stroke. Such pumps are single stage pumps and typically can yield 125 psi, perhaps 250 psi in a high performance design.

There are applications that require much higher operating pressure, such as compressed air tanks used for regulated breathing, air tools, and other applications. One application where high pressure air is required is with high performance air rifles. Such rifles rival performance of light caliber firearms, and may yield muzzle velocities approaching 1200 fps. In order to achieve such velocities, an air reserve tank is coupled to the rifle that provides air pressure in the 1500 psi to 3600 psi range. Air rifle users employ manually operated reciprocal air pumps to fill such tanks. However, the high pressures needed cannot be achieved with a single stage reciprocal pump. Multi-stage pumps are needed to achieve these pressure levels. Multi-stage reciprocal air pumps are known, which can achieve compressed air outlet pressures in excess of 2000 psi. Multi-stage multi-chamber pumps generally employ plural concentric cylinders divided into plural chambers using seals of various types and pistons, with successively smaller displacement volumes that enable the inlet air to be compressed to high levels through multiple stages of compression.

As the level of compression of the outlet air rises, so too does the number of mechanical and operation issues in the design and operation of the pump. While a simple bicycle pump can function without lubrication in the presence of dust and moisture, and suffice with leather flaps for a check valves, high pressure pumps will develop a number of operational problems, and have a greatly reduced useful life in the same environment. Even considering just the ideal gas law, those skilled in the art will appreciated the highly elevated temperature rise between the inlet ambient air and the compressed outlet air in a high pressure reciprocal pump. Heat, with that addition of dust, particulate or moisture, greatly challenges the design process. Design factors quickly become critical as the target outlet pressure increases. Such design problems can be partially overcome using higher quality materials, higher performance lubricants, and tighter design specifications, however, it must be appreciated that such refinements come at increased production costs. Consumers of such pumps may be unwilling to pay the additional cost of such refinements. The inventor hereof has previously filed a co-pending patent application entitled High Pressure Air Pump on May 19, 2008, and assigned U.S. Patent Office Ser. No. 12/122,882. The reciprocating air pump of that patent application has demonstrated excellent performance and has achieved commercial success. However, during operation of the High Pressure Air Pump, it has been observed that a great number of manually driven reciprocating pump strokes are required to raise the pressure in an attached compresses air tank to a desired level, particularly during periods of time where substantial consumption of the compressed air occurs. Thus it can be appreciated that there is a need in the art for a high pressure, multiple-stage, multiple chamber reciprocal air pump that can achieve high pressure, that has an adequately long useful life, that is offered at a competitive price point so as to be desirable to consumers, but also which can be driven by a means other than manual operation.

SUMMARY OF THE INVENTION

The need in the art is addressed by the apparatus of the present invention. The present invention teaches a reciprocating air pump apparatus that includes a frame and a pump for compressing air through a series of linear close-strokes and open-strokes performed between a first portion that is fixed in position with respect to the frame and a reciprocating portion. The pump includes plural cylinders, slideably and sealably engaged therein, and arranged as multiple-chambers defining multiple-stages, which thereby enabling the series of close-strokes and open-strokes to compress air. The apparatus also includes a manifold having an air inlet cavity with an inlet vent disposed on the exterior, and having a compressed air outlet cavity formed therein with an outlet vent disposed on the exterior. The apparatus also includes an outlet valve body disposed between the first portion of the pump and the manifold, with an outlet valve pneumatically coupled to direct high-pressure compressed air into the outlet cavity, and with an inlet port pneumatically coupled to the inlet cavity. A reciprocating linear drive that has an electric motor is fixed to the frame and delivers linear force to the reciprocating portion of the pump. A control system is coupled to the electric motor and operates to sequentially alternate the direction of force of the reciprocating linear drive, which enables reciprocating application of linear force to the reciprocating portion.

In a specific embodiment of the foregoing apparatus, the air inlet cavity is arranged in thermally conductive proximity to the outlet valve body, which enables transfer of heat from compressed air output from the reciprocating air pump to ambient air drawn into the reciprocating air pump. In another specific embodiment, the inlet air cavity is formed as an annular cavity between the manifold and the outlet valve body. In another specific embodiment, the reciprocating air pump further includes an inlet air filter coupled to the inlet vent for filtering ambient air prior to entering the reciprocating air pump. In another specific embodiment, the manifold has cooling fins formed on its exterior surface to facilitate heat transfer from the manifold to the ambient environment.

In a specific embodiment of the foregoing apparatus, the reciprocating linear drive includes a rack and pinion gear that is driven by the electric motor. In a refinement to this embodiment, the electric motor is a gear motor terminated with the pinion gear. In another specific embodiment, the control system further comprises a means for reversing polarity of electric current to the motor to sequentially alternate the direction of rotation thereof. In another specific embodiment, the apparatus further includes a first position detector coupled to the control system that is aligned to detect the position of the reciprocal portion.

In a specific embodiment of the foregoing reciprocating air pump, wherein the pump is configured for a predetermined length of stroke between a fully closed position and a fully open position, the apparatus further includes a first position detector coupled to the control system and aligned to indicate that the reciprocal portion is at the fully closed position, and a second position detector coupled to the control system and aligned to indicate that the reciprocal portion is at the fully open position. The control system then reverses the direction of force applied by the reciprocating linear drive upon indication that the reciprocal portion has reached either of the fully open position or the fully closed position. In a refinement to this embodiment, the first position detector and the second position detector are limit switches. In another refinement to this embodiment, the reciprocating air pump further includes an engagement member fixed to the reciprocating portion that is aligned to engage the first position detector and the second position detector.

In a specific embodiment of the foregoing apparatus, the reciprocating drive applies force to the reciprocating portion to induce a predetermined velocity of movement. In a refinement to this embodiment, the predetermined velocity is selected to correspond to a rate of operation of a manually driven air pump. In another refinement to this embodiment, the predetermined velocity is approximately one hundred twenty millimeters per second.

Another embodiment of the present invention teaches a reciprocating air pump apparatus that includes a frame and a pump for compressing air through a series of linear close-strokes and open-strokes performed between a reciprocating portion and a fixed portion that is fixed in position with respect to the frame. The reciprocating portion has a driven end and a first engagement end. The reciprocating portion further includes an outer cylinder with a closed cap at the driven end and a seal assembly at the first engagement end. A piston rod is co-axially disposed within the outer cylinder, and fixed to the closed cap at the driven end, and has a piston fixed to the first engagement end, where the piston also has a piston valve. The fixed portion has a fixed end and a second engagement end. The fixed portion further includes a manifold at the fixed end, with an ambient air inlet cavity and inlet vent, and a compressed air outlet cavity and an outlet vent, formed therein. An outlet valve body is fixed to the manifold that has an outlet valve pneumatically coupled to the outlet cavity, and that has an inlet port pneumatically coupled to the inlet cavity. A middle cylinder is coupled to the outlet valve body at the fixed end and coupled to a transfer valve body at the second engagement end. An inner cylinder is coaxially disposed within the middle cylinder, and is coupled to the outlet valve body at the fixed end and coupled to the transfer valve body at the second engagement end. Additionally, the middle cylinder and the inner cylinder form an inlet annular chamber between them, which is bounded by the inlet valve body and the transfer valve body, and, the inlet annular chamber is pneumatically coupled to the inlet port. A the first engagement end of the reciprocating portion slideably engages the second engagement end of the fixed portion, and thusly enables the sequence of close-strokes and open-strokes. The outer cylinder, the middle cylinder, the inner cylinder and the piston rod are coaxially arranged in respective order of decreasing diameters. The transfer valve body sealably engages the piston rod and sealably engages the interior surface of the outer cylinder, thereby defining an first annular chamber bounded by the transfer valve body and the closed cap. The transfer valve body further includes an inlet valve disposed to direct the flow of air from the inlet air chamber into the first annular chamber on the open-stroke. The seal assembly sealably engages the exterior surface of the middle cylinder, and thereby defines a second annular chamber bounded by the seal assembly and the transfer valve body. The transfer valve body further includes a transfer valve disposed to direct the flow of air from the first annular chamber to the second annular chamber on the close-stroke. The piston sealably engages the interior of the inner cylinder and thereby defines a rod chamber bounded by the piston and the transfer valve body, and further defines a piston chamber bounded by the piston and the outlet valve body. The transfer valve body further includes a transfer port disposed to allow air to flow from the second annular chamber into the piston rod chamber on the open-stroke. The piston valve directs the flow of air from the rod chamber to the piston chamber on the open-stroke. The outlet valve directs air the flow from the piston chamber to the outlet cavity on the close-stroke. The reciprocating air pump also includes reciprocating linear drive that has an electric motor. The drive is fixed to the frame to deliver linear force to the driven end of the reciprocating portion of the pump. The reciprocating air pump also includes a control system coupled to the electric motor that sequentially alternates the direction of force of the reciprocating linear drive, thereby enabling reciprocating movement of the reciprocating linear drive along a predetermined length of stroke between a fully closed position and a fully open position.

In a specific embodiment to the foregoing reciprocating air pump, the reciprocating linear drive includes a rack and pinion gear, that is driven by the electric motor. Further, the electric motor is a gear motor terminated with the pinion gear. Additionally, the control system includes a means for reversing polarity of electric current to the motor to sequentially alternate the direction of rotation thereof.

In a specific embodiment to the foregoing reciprocating air pump, the pump is configured for a predetermined length of stroke between a fully closed position and a fully open position. The apparatus further includes an engagement member that is fixed to the reciprocating portion. Additionally, it includes a first limit switch coupled to the control system and aligned to engage the engagement member to indicate that the reciprocal portion is at the fully closed position, and a second limit switch coupled to the control system and aligned to engage the engagement member to indicate that the reciprocal portion is at the fully open position. Then, the control system reverses the direction of force applied by the reciprocating linear drive upon indication that the reciprocal portion has reached either of the fully open position or the fully closed position.

In a specific embodiment to the foregoing reciprocating air pump, the reciprocating drive applies force to the reciprocating portion to induce a predetermined velocity of movement that is selected to correspond to a rate of operation of a manually driven air pump.

BRIEF DESCRIPTION OF THE DRAWINGS

FIG. 4 is a partial section view drawing of a manifold and fixed portion of a reciprocating air pump according to an illustrative embodiment of the present invention.

FIG. 5 is a partial section view drawing of a reciprocating drive interface in a reciprocating air pump according to an illustrative embodiment of the present invention.

DESCRIPTION OF THE INVENTION

Figure 2:
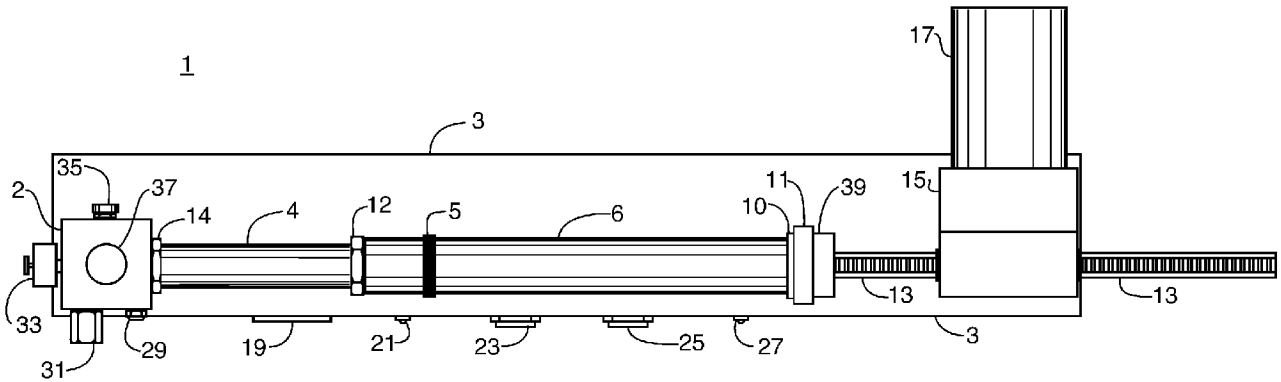
FIG. 2 is a top view drawing of a reciprocating air pump according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and the method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

As was discussed hereinbefore, the inventor hereof has filed an earlier patent application, co-pending, entitled High Pressure Air Pump, on May 19, 2008, and assigned U.S. Patent Office Ser. No. 12/122,882. The entire content of that disclosure is hereby incorporated by reference. The manually operated reciprocating air pump of that invention includes a footrest at the lower end and a handle at the upper end. During manual operation, a user places his feet on the footrest and hands on the handle so as to manually drive the reciprocating portion of the pump up and down in a sequence to compress air. These pumps routinely achieve pressures in excess of 3000 psi. In an exemplary application, a user may be shooting an air rifle, gradually consuming compressed air in a reserve tank, perhaps discharging the tank pressure from 3100 psi to 1500 psi. Of course, this causes the air rifle to gradually reduced muzzle velocity. At some point, the user elects to recharge the reserve tank, and connects it to the air pump and commences pumping. At first, the user may work aggressively to fill the tank, perhaps pumping as quickly as one full up-down stroke per second. Since it take a large number of successive strokes to increase the tank pressure to 3100 psi, the user will tire, and the rate of pumping gradually decreases. In an exemplary application, the manually drive pump requires approximately 200 strokes to increase an air rifle tank pressure from 1500 psi to 3100 psi. As the work continues, the rate of pumping reduces, perhaps to one full stroke every 10-12 seconds. With these operational metrics known by the inventor, the heat management, lubrication, material selection, components, wear and service life of the pump were calibrated to the intended application by the end user. An affordable and competitive product for the market has thusly been realized.

It is readily appreciated that there is a demand for a powered air pump replacement for some users of manually operated air pumps discussed in the previous paragraph. Of course, high-pressure gas pumps are known in the prior art, as is demonstrated by the prior art submitted with this invention.

However, all of the prior art high-pressure pumps are designed for high performance applications where larger volumes and powerful energy sources are used. For example, compressors used to fill SCUBA diving tanks typically employ powerful electric motors or gasoline engines as a prime mover. Such compressors are similar to industrial and commercial air compressors, employing rotary crank shafts, connecting rods and pistons. Higher pressure can be achieved using higher compression ratios, higher specification components, and successive stages of compression. The fundamental problem with such prior art compressors is that the "high-spec" designs carry a substantial cost. Compared to the aforementioned manual air pumps, the "high-spec" compressors may cost dozens of times as much, and this has been prohibitive to the market for lower volume, high pressure compression requirements of the manual pump varieties.

The present invention advances that prior art by providing designs that achieve the requisite performance characteristics and cost metrics heretofore unavailable. The teachings herein address the problems in the art with a multiple stage reciprocating air pump with a reciprocating linear drive, and that employs a manifold and outlet valve body that manage both the flow of inlet air and compressed outlet air such that inlet air is drawn from a fixed location that is filtered and may optionally include a desiccant cartridge. The inlet air is routed in thermal proximity to the outlet valve such that heat is drawn away from the outlet valve body, thereby mitigating certain issues that arise where high compression levels are employed, particularly where the reciprocating linear drive is operated for continuous periods of time, such as an hour or more.

Figure 1:
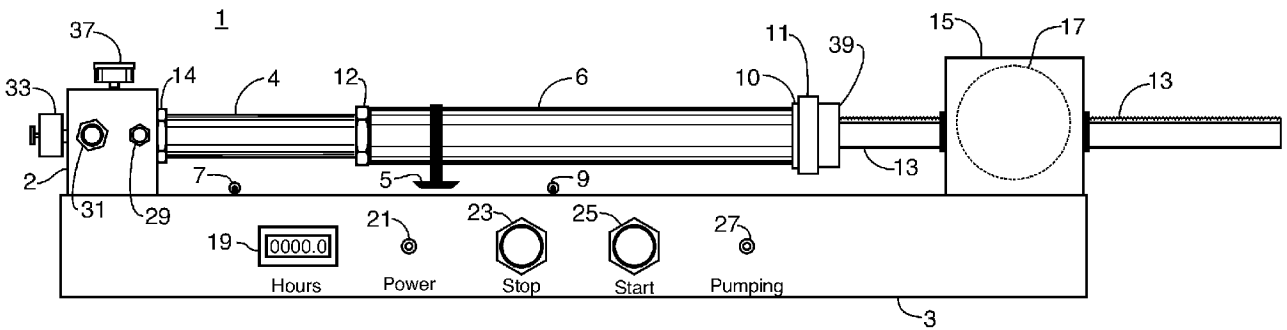
FIG. 1 is a side view drawing of a reciprocating air pump according to an illustrative embodiment of the present invention.

FIG. 1 and FIG. 2, which are a top view drawing and side view drawing, respectively, of a reciprocating air pump according to an illustrative embodiment of the present invention. The pump apparatus 1 is assembled on a frame 3, which is an aluminum box structure in the illustrative embodiment. The reciprocating pump itself primarily consists of a fixed portion 4 and a reciprocating portion 6, which sealably and slidably engage one another about a seal assembly 12. The fixed portion 4 is fixed to a manifold 2 at its fixed end by outlet valve assembly 14. The manifold 2 is fixed to the frame 3. The reciprocating portion 6 is connected to a geared rack 13 by a closed cap 10 and a connector 11. A resilient impact bumper 39 provides a cushion. The geared rack 13 is a portion of a rack and pinion assembly 15 interfaced to a gear motor 17. The gear motor 17 and rack and pinion drive 15 are fixed to the frame 3. Rotation of the gear motor 17 induces linear force and linear movement to the geared rack 13, which in turn, drives the reciprocating portion 6 of the pump. In the illustrative embodiment, the gear motor 17 is a twelve volt DC motor, which is suitable for operation with a vehicular power supply, or may be powered using a power line transformer power supply. Reversing the polarity of the DC current in the gear motor 17 reverses its direction of rotation, which also reverses the direction of linear movement of the geared rack 13. By alternating the polarity of the electric current driving to the gear motor 17, the geared rack 13 and reciprocating portion 6 of the pump can be driven in the closed and open direction alternatingly.

The manifold 2 in FIG. 1 and FIG. 2 provides the pneumatic connections and certain control functions in the illustrative embodiment. An air inlet filter 29 provides a filter function to the air vent that it is threadably engaged with. An outlet fitting 31 threadably engages an outlet vent, and is adapted to threadably engage a compressed air tank (not shown). A bleed valve 35 is pneumatically coupled to the high pressure outlet cavity in the manifold 2, and provides a means for the user to manually relieve pressure in the pump. A pressure gauge 37 provides a visual indication of the outlet and tank pressure. An adjustable pressure switch 33 provides a pressure limit input to the control system (not shown), and is user adjustable to specify the desired set-point pressure, at which the control system deactivates the pumping function.

The frame 3 provides a base housing for the control system (not shown). User interface controls are presented on the exterior of the frame 3 in FIG. 1 and FIG. 2. An hour meter 19 provides a running accumulations of the total run time of the pump apparatus, and is useful to establish wear and service requirements for the apparatus. A power lamp 21 illuminates to indicate the apparatus has electric power and is therefore ready to be operated. Start 23 and stop 25 actuators are provided to selectively start and stop the reciprocating pumping action, respectively. A "Pumping" lamp 27 illuminates while the reciprocating drive is powered and operating. Control of the movement and reciprocating operation is managed by the control system (not shown) through operation of the actuators 23, 25, and 33 in combination with two position detectors 7 and 9 operating cooperatively with and engagement member 5. The engagement member 5 is fixed to the reciprocating portion 6 of the pump apparatus and travels in the closed and open direction during pumping operation. It is aligned to actuate the position detectors 5 and 7, thereby providing a position signal to the control system. Upon receipt of such a control input, the control system reverses the electric current polarity driving the gear motor 17, thusly reversing the direction of the pump movement between opening and closing, and causing the reciprocating operation.

Figures 3A, 3B, 3C:
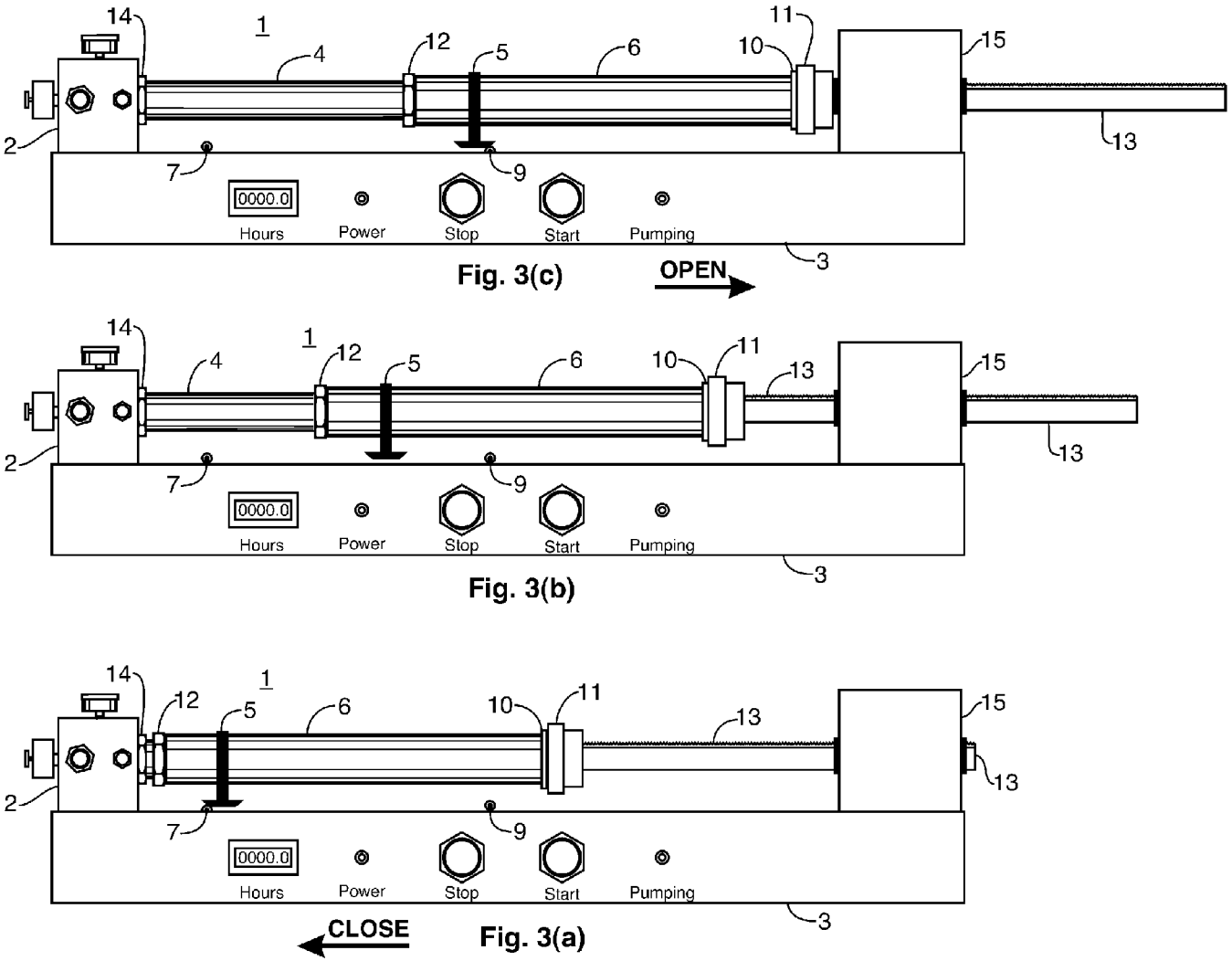
FIGS. 3(*a*), 3(*b*) and 3(*c*) are sequential side view drawings of a reciprocating air pump according to an illustrative embodiment of the present invention.

Reference is directed to FIGS. 3(*a*), 3(*b*) and 3(*c*), which are sequential side view drawings of a reciprocating air pump 1 according to an illustrative embodiment of the present invention. The frame 3 provides the base for the manifold 2 and the rack and pinion assembly 15, which support both the fixed portion 4 and reciprocating portion of the pump. In FIG. 3(*a*), the geared rack 13 has driven the reciprocating portion 6 of the pump to the fully closed position, and to the peak of the compression cycle of the pump 1. At the fully closed position, the engagement member 5 actuates the first position detector 7, which provides an input to the control system (not shown) to reverse the direction of the rack and pinion assembly 15. In the illustrative embodiment, the first position detector 7 and second position detector 9 are micro-switches, which provide contact closure electrical outputs. Those skilled in the art will appreciate that various position detecting switches, sensors and devices could be employed to detect when the reciprocal portion 6 has reached either extreme closed or open position. In FIG. 3(*b*), the reciprocal portion 6 of the pump is traversing between the fully closed position and the fully open position. In this state, neither of the position detectors 7, 9 are providing an actuation signal to the control system (not shown), so the rack and pinion assembly continues driving unabated. In FIG. 3(*c*), the pump 1 has been driven to the fully open position, also the peak of the intake stroke. In this position, the engagement member 5 actuates the second position detector 9, which couples that signal to the control system. In response, the rack and pinion is again reversed in direction, thereby enabling a reciprocating operation of the pump 1.

In general, as the pump closes, the internal chambers are reduced in volume to compress the air through successive stages. As the pump opens, fresh air is drawn into the pump, and partially compressed air is advanced in sequence, including partial compression in intermediate stages. More detailed descriptions of the internal operations of the air pump are provided hereinafter. I can be appreciated that the reciprocating action of the pump 1 in FIG. 3 presents some risk of harm, with the moving parts and possible pinch points. An illustrative embodiment contemplates a protective cover to prevent access to the moving portions of the apparatus. It will also be appreciated by those skilled in the art that the reciprocating drive of the pump must provide a substantially linear force on the reciprocating portion 6 of the pump, and which is in parallel with the longitudinal axis of the pump. Any transverse or eccentric forces will reduce the reliability and service life of the pump 1. While a linear rack and pinion drive assembly is provided in this illustrative embodiment, those skilled in the art will appreciate that other drive mechanism capable of delivering linear force along the longitudinal axis of the reciprocating portion of the pump could readily be utilized.

Another significant aspect of the pump design is the velocity of the reciprocating linear drive and the cyclic rate of the reciprocating pump. Obviously, the designer has access to a wide range of drive speeds, and it may be deemed useful or desirable to operate the linear drive at velocities and cyclical rates that exceed the rates at which a user might operate the pump manually. However, the illustrative embodiment contemplates cyclical rates consistent with manual operation so as to manage heat build up, lubrication performance, manufacturing tolerances, material selection, production costs, and ongoing maintenance requirements. Thus, the range of cyclical rates contemplates a range from approximately one second per pump cycle to approximately six seconds per pump cycle. In the illustrative embodiment, the pump stroke is approximately 178 mm, with the linear reciprocating drive moving at 120 mm per second, yielding a cyclic rate of approximately three seconds per pump cycle, which has been demonstrated to be an effective rate of operation for sustained operation of the pump. In this illustrative embodiment, the pump can be fabricated from mild steel tubing and machined brass fittings, and be provided with lifetime petroleum lubricants at the time of manufacture. Internal seals can be selected from conventional low cost polymers, such as synthetic rubbers, and low cost thermosets, as are known to those skilled in the art.

FIG. 4 is a partial section view drawing of a manifold 2 and fixed portion 4 of a reciprocating air pump according to an illustrative embodiment of the present invention. The manifold 2 serves several functional purposes in the illustrative embodiment. First, the manifold 2 couples the fixed portion 4 of the pump to the to the frame (not shown) by connection through the outlet valve body 14 disposed between the fixed portion 4 and the manifold 2. The outlet valve body 14, in turn, internally connects to the inner cylinder 36 and the middle cylinder 4 (which is also generally referred to as the "fixed portion, since it is visible from the exterior of the pump). Second, the manifold 2 manages heat flow and thermal management between fresh air inlet to the pump and compressed air outlet from the pump, which will be more fully discussed hereinafter. Third, the manifold 2 provides a unified position for the pneumatic connection points for the pump, including the inlet filling 26, the outlet fitting 34, the pressure switch fitting 30, the bleed valve fitting 32 and the pressure gauge fitting (not shown in this view).

FIG. 5 is a partial section view drawing of a reciprocating drive interface in a reciprocating air pump according to an illustrative embodiment of the present invention. This interface connects the geared rack 13 of the reciprocating drive unit (not show) to the reciprocating portion 6 of the pump. The reciprocating portion 6 of the pump is visible as the outer cylinder 6 of the pump, which is terminated by a closed cap 10. The closed cap 10 is also connected to the internal piston rod 40 within the pump. These internal arrangements will be more fully discussed hereinafter. The geared rack 13 is attached to the closed cap 10 using a connector 11. In the illustrative embodiment, the connector is fabricated from aluminum alloy and is fixed to the gear rack 13 using a threaded bold 43, and is connected to the closed cap 11 using a pair of cap screws 43. Those skilled in the art will appreciate that other connection arrangements are readily available, with the essential requirement being that the linear force of the drive is effectively coupled tot he reciprocating portion 6 of the pump.

Figure 6:
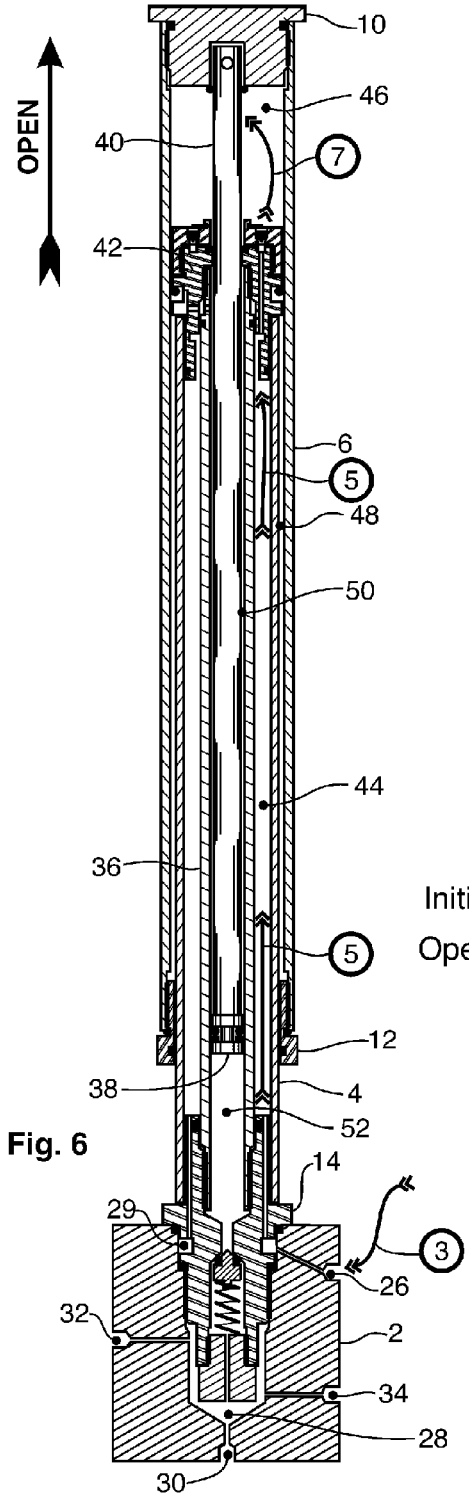
FIG. 6 is a section view drawing of a reciprocating air pump illustrating the intake airflow on the open-stroke according to an illustrative embodiment of the present invention.
Figure 7:
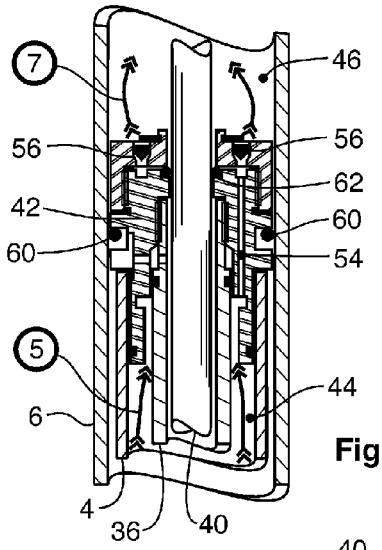
FIG. 7 is a detailed section view drawing of a reciprocating air pump illustrating the intake airflow on the open-stroke according to an illustrative embodiment of the present invention.
Figure 8:
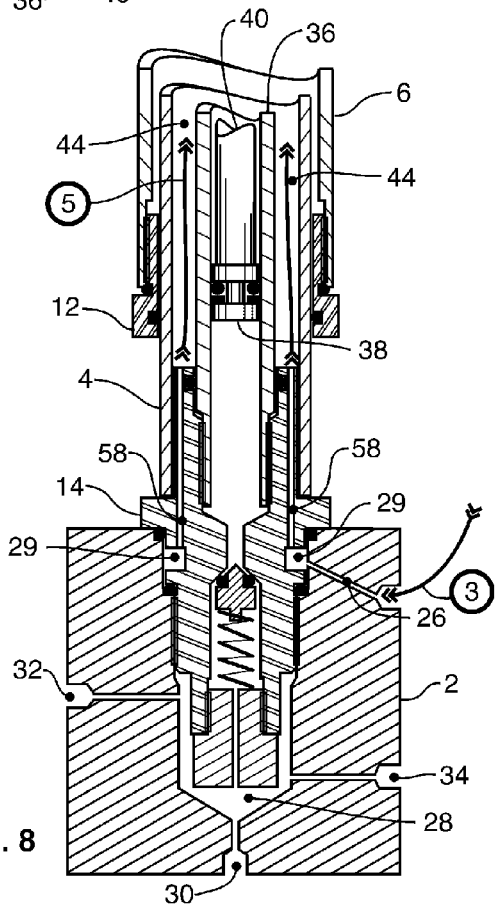
FIG. 8 is a detailed section view drawing of a reciprocating air pump illustrating the intake airflow on the open-stroke according to an illustrative embodiment of the present invention.

Reference is directed to FIG. 6, FIG. 7, and FIG. 8, which are section view drawings, including detailed section views, of a reciprocating air pump illustrating the intake airflow on the open-stroke according to the illustrative embodiment of the present invention. During the open-stroke, two pump actions occur, and these are the initial intake and the secondary compression actions. FIGS. 6, 7, and 8 are presented to illustrate the initial intake action only. The secondary compression action will be discussed hereinafter. The manifold 2 is machined with a series of cavities used to route airflow through the pump. Among these is the outlet cavity 28, which is pneumatically coupled to plural threaded ports, which engage the various pneumatic connections. These include the outlet fitting port 34, the pressure gauge fitting port (not shown in this view), the pressure switch fitting port 30, and the pressure bleed valve fitting port 32. The outlet valve body 14 is threadably engaged with the manifold 2 and delivers compressed outlet air into the outlet air cavity 28. When the outlet valve body 14 is engaged with the base housing, a machined cavity therebetween is formed as an annular inlet air cavity 29 about the outer periphery of the outlet valve body 14. The annular cavity portion 29 is pneumatically coupled to the inlet air cavity 26 in the manifold 2, which is where the inlet air 3 enters the manifold 2. Thus, the inlet air is in thermal proximity with the manifold 2 and the outlet valve body 14. An inlet air port 58 is formed through the outlet valve body 14 that pneumatically couples the inlet annular cavity 29, 26 into an inlet annular chamber 44 formed between the middle cylinder 4 and an inner cylinder 36, both of which are coupled to the outlet valve body 14. Thus, upon the open-stroke, air flows 3 into the inlet air cavity 26 and flows through 5 the inlet annual chamber 44. At the upper end of the middle cylinder 4 and the inner cylinder 36 is the transfer valve body 42. Note that the terms "upper" and "lower", as well as "upwardly" and "downwardly", will be used as reference identifying terms, oriented according to the orientation of the drawing figures on the page, and are not intended to limit the orientation of the illustrative embodiment pump in any way.

On actuation of an open-stroke, inlet air flows 5 through the inlet annular chamber 44, through a port 54 in the transfer valve body 42, and through an inlet check valve 56 into 7 an upper annular chamber 46. The upper annular chamber 46 is formed between the outer cylinder 6 and a piston rod 40, and is bounded at the lower end by the transfer valve body 42 and the upper end by a closed end 10 of the outer cylinder 6. The transfer valve body 42 includes a seal 60 that engages the interior surface of the outer cylinder 6, and another "O"-ring seal 62 that engages the piston rod 40. Thusly, the upper annular chamber 46 is essentially airtight, except for the air allowed to pass 7 thereinto through the inlet valve 56. Therefore, when the reciprocating portion of the pump is drawn openwardly, a vacuum is formed in the upper annular chamber 46, which draws the air flow 3 into the manifold 2, upwardly 5 through the inlet annular chamber 44, through the inlet valve 56 and into 7 the upper annular chamber 46. It should be noted that the seal 60 between the transfer valve body 42 and the outer cylinder includes an 'O'-ring that shifts within an annular groove on the outer periphery of the transfer valve body 42. The shift in the "O"-ring position is caused by the relative movement of the outer cylinder 6 with respect to the transfer valve body 42. On the open-stroke, the shift in position of the "O"-ring perfects the seal 60 between the outer cylinder 6 and the transfer valve body 42. The action of seal 60 on the down-stroke induces a check valve function, which will be discussed hereinafter.

Figure 9:
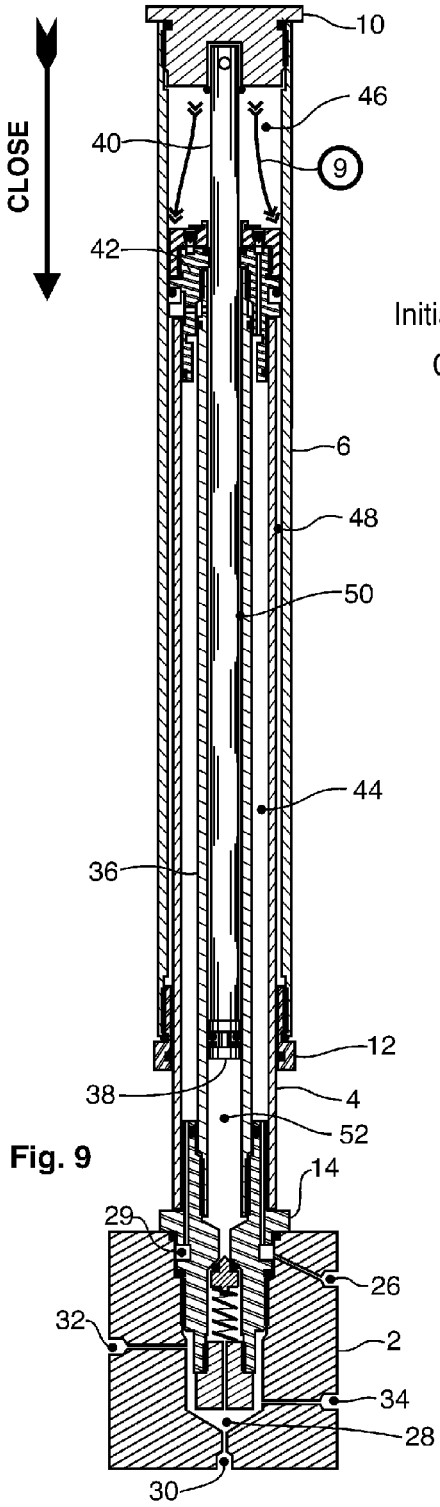
FIG. 9 is a section view drawing of a reciprocating air pump illustrating the initial compression stage on the close-stroke according to an illustrative embodiment of the present invention.
Figure 10:
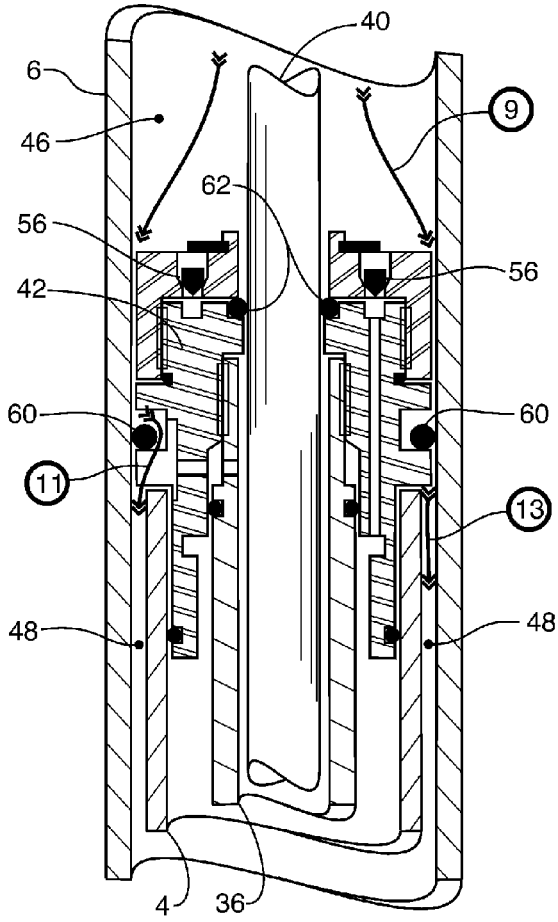
FIG. 10 is a detailed section view drawing of a reciprocating air pump illustrating the initial compression stage on the close-stroke according to an illustrative embodiment of the present invention.

Reference is directed to FIG. 9, and FIG. 10 which are section view drawings of a reciprocal pump, including a detailed section view, illustrating the initial compression stage on the close-stroke according to an illustrative embodiment of the present invention. During the close-stroke action, two pump actions occur, and these are the initial compression and the final compression actions. FIGS. 9 and 10 are presented to disclose the initial compression action only. The final compression action will be discussed hereinafter. With the upper annular chamber 46 having been charged with fresh intake air on the previous open-stroke, the subsequent close-stroke initiates the compression of this air charge. The air 9 is compressed and forced downwardly. As the outer cylinder 6 begins downward movement, the "O"-ring of seal 60 on the transfer valve body 42 is shifted downwardly, which exposes a grooved recess on the transfer valve body 42 that allows the air charged to flow 11 past the seal 60. This air flow 11 is directed into a lower annular chamber 48. The lower annular chamber 48 is formed between the interior surface of the outer cylinder 6 and the exterior surface of the middle cylinder 4. The lower annular chamber 48 is bounded on the lower end by seal 12, which includes an "O"-ring that slideably and sealably engages the outer cylinder 6 and the middle cylinder 4. The lower annular chamber 48 is bounded at the upper end by the transfer valve body 42. Thus, the air charge in the upper annular chamber 46 is forced past seal 60 into the lower annular chamber on the close-stroke. By this action, seal 60 functions as a transfer check valve for the flow of air during the close-stroke. Therefore, item 60 is a seal on the open-stroke and a transfer valve on the close-stroke. Note that the volume of the upper annular chamber 46 at full extension of the pump is substantially larger than the volume of the lower annular chamber 48 at full compression of the pump. This differential in volume results in a compression of the air as it flows 11 into the lower annular chamber 48. The relationship of these volumes is better appreciated with reference to a section view taken across the longitudinal axis of the pump.

Figure 11:
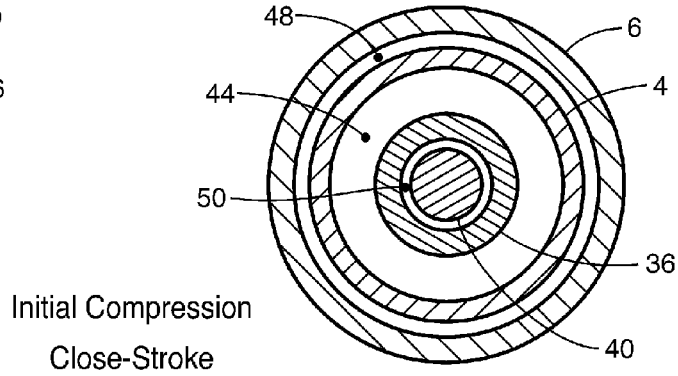
FIG. 11 is a cross-section view drawing of a reciprocating air pump according to an illustrative embodiment of the present invention.

Reference is directed to FIG. 11, which is a section view drawing of a reciprocating pump according to an illustrative embodiment of the present invention. This is a section view across the longitudinal axis of the pump, and illustrates the relative diameters of the various cylinders and the respective chambers that they define. The cylinders and piston rod 40 in the illustrative embodiment are fabricated from mild steel. The space between the outer cylinder 6 and middle cylinder 4 defines the cross sectional area of the lower annular chamber 48. This is much smaller than the cross sectional area of the upper annular chamber, which is the space between the outer cylinder 6 and the piston rod 40. The space between the middle cylinder 4 and the inner cylinder 36 defines the inlet annular chamber 44, which is not a compression chamber, but rather is a conduit for the flow of inlet air to the transfer valve body. For reference hereinafter, the space between the inner cylinder 36 and the piston rod 40 defines the rod chamber 50.

Figure 12:
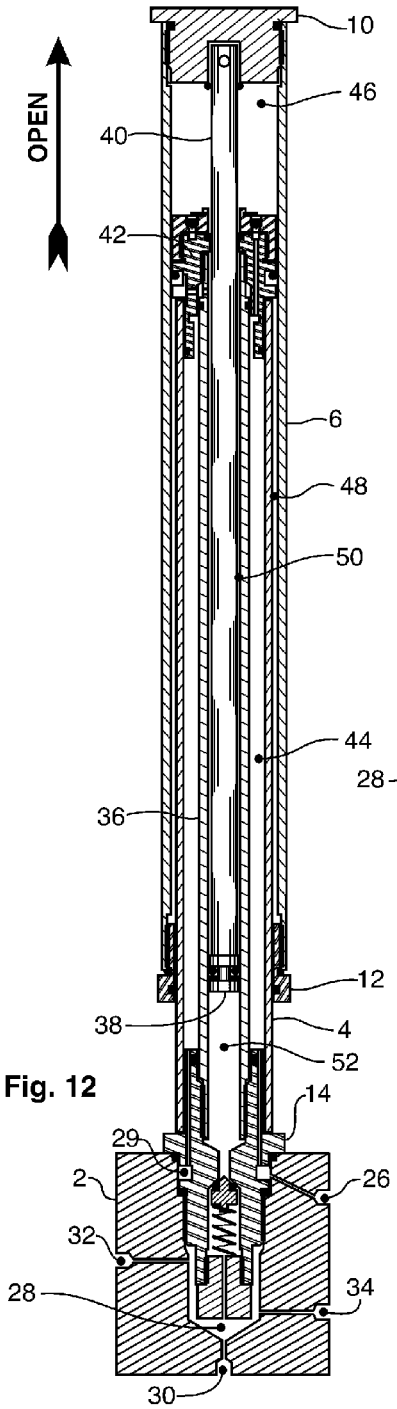
FIG. 12 is a section view drawing of a reciprocating air pump illustrating the secondary compression stage on the open-stroke according to an illustrative embodiment of the present invention.
Figure 13:
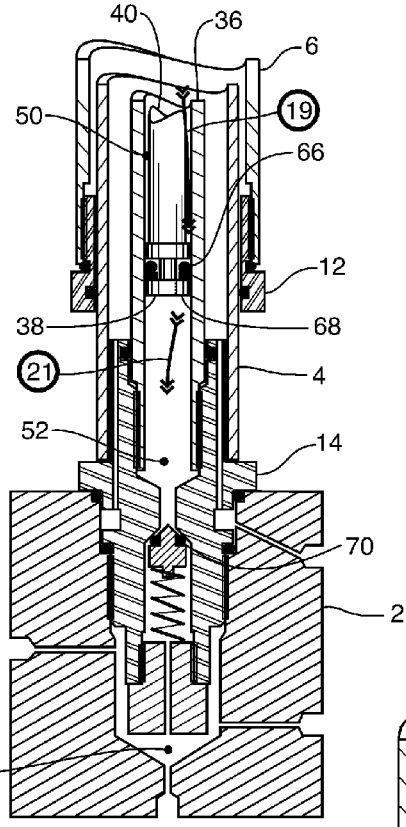
FIG. 13 is a detailed section view drawing of a reciprocating air pump illustrating the secondary compression stage on the open-stroke according to an illustrative embodiment of the present invention.
Figure 14:
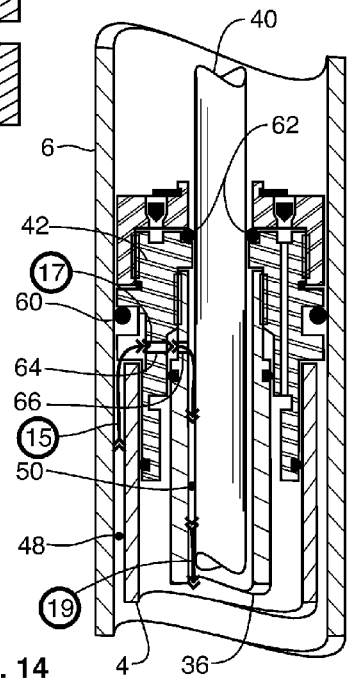
FIG. 14 is a detailed section view drawing of a reciprocating air pump illustrating the secondary compression stage on the open-stroke according to an illustrative embodiment of the present invention.

Reference is directed to FIG. 12, FIG. 13, and FIG. 14, which are section view drawings, including detailed section view drawings, of a reciprocating air pump illustrating the secondary compression stage on the open-stroke according to an illustrative embodiment of the present invention. In addition to the aforementioned ambient air intake process that occurs on the open-stroke, a secondary compression action also occurs on the open-stroke. The air that was compressed into the lower annular chamber 48 during the previous close-stoke is further compressed 15 on the open-stroke. Since the "O"-ring of seal 60 is urged upwardly on the open-stroke, the seal action is again perfected so the air charge in the lower annular chamber 48 is urged 17 through a transfer port 64 in the transfer valve body 42 and further urged 17 through a port 66 formed through the inner cylinder 36. This causes the air to compress 19 into the rod chamber 50. The rod chamber 50 is formed between the inner surface of the inner cylinder 36 and the piston rod 40. It is bounded on the lower end by piston 38 and on the upper end by transfer valve body 42, which is sealed to the piston rod 40 by "O"-ring seal 62. A piston check valve 66 allows the air flow 19 to pass through a piston port 68 formed in the piston 38 such that the air further compresses 21 into piston chamber 52. The piston check valve 66 comprises an "O"-ring the traverses an annular groove formed about the piston such that the "O"-ring is urged downwardly on the open-stroke so as to expose the piston port 68 to enable air flow 21 into the piston chamber 52. The piston chamber is defined by the interior of the inner cylinder, and is bounded by the piston 38 at the upper end and the outlet valve body 42 and outlet valve 70 at the lower end. On completion of the open-stroke, a charge of compressed air is transferred 15, 17, 19, 21 and further compresses from the lower annular chamber 48 into the piston chamber 52.

Figure 15:
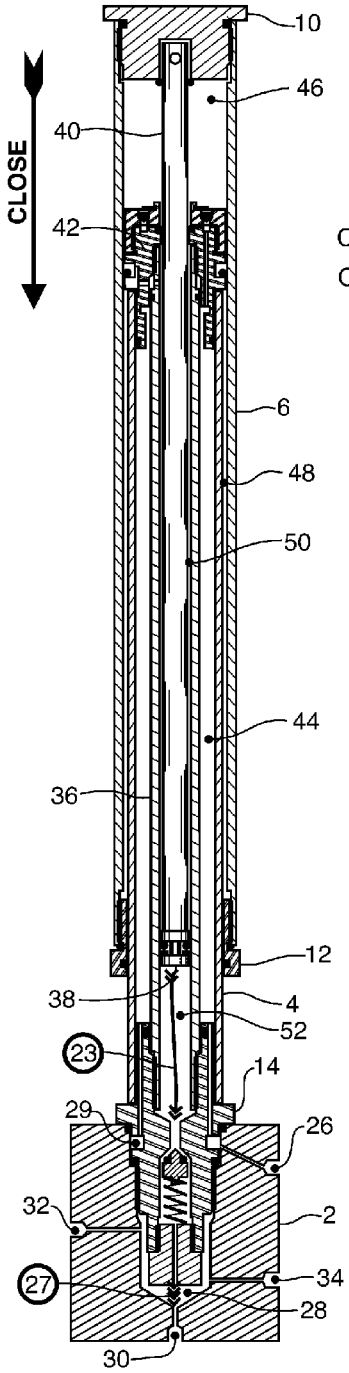
FIG. 15 is a section view drawing of a reciprocating air pump illustrating the final compression stage on the close-stroke according to an illustrative embodiment of the present invention.
Figure 16:
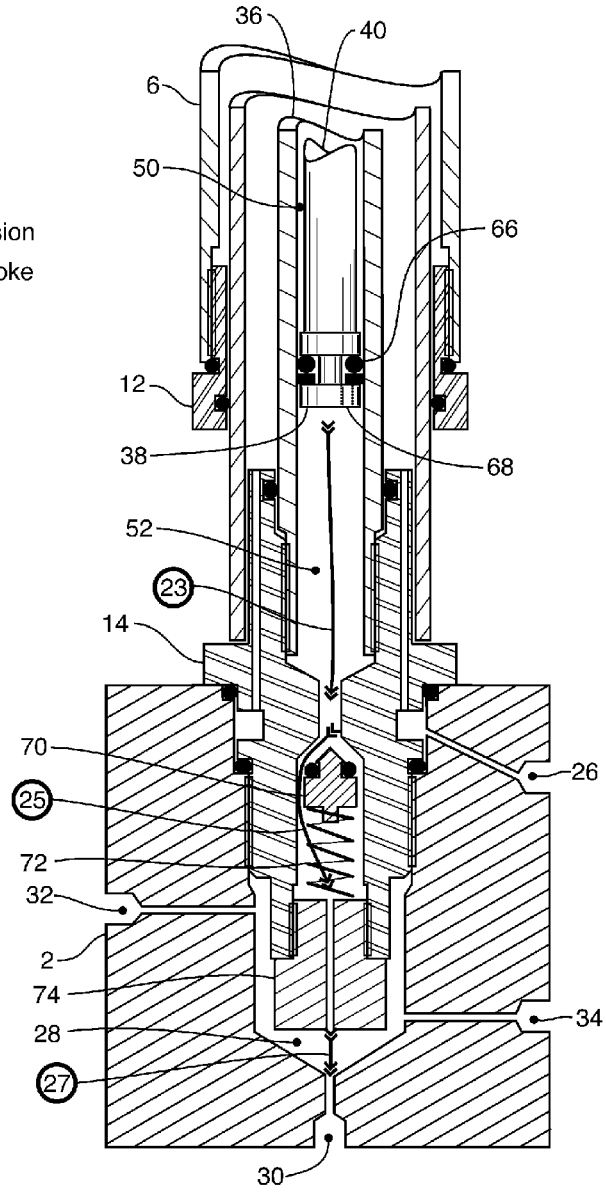
FIG. 16 is a detailed section view drawing of a reciprocating air pump illustrating the final compression stage on the close-stroke according to an illustrative embodiment of the present invention.

Reference is directed to FIG. 15 and FIG. 16, which are a section view and detailed section view drawing of a reciprocating air pump illustrating the final compression stage on the close-stroke according to an illustrative embodiment of the present invention. Upon initiation of the subsequent close-stroke, the "O"-ring in the piston check valve 66 is urged upwardly, which perfects a seal between the piston 38 and the interior surface of the inner cylinder, which effective seals the rod chamber 50 from the piston chamber 52. Further close-stroke movement compresses 23 the air charge in the piston chamber 52, which urges outlet valve 70 open, allowing air to flow past 25 the outlet valve 70 and into the 27 the outlet cavity 28 in the manifold 2. Note that the dramatic compression, reaching pressures in excess of 2000 psi, even as high as 3100 psi cause a great increase in the temperature of the compressed air and outlet valve body 14, as well as the outlet valve 70 itself. The annular chamber 29, through which the cool inlet air flows, serves to remove a portion of the heat generated at the outlet, thereby enhancing operation and performance of the reciprocal pump.

Figure 17:
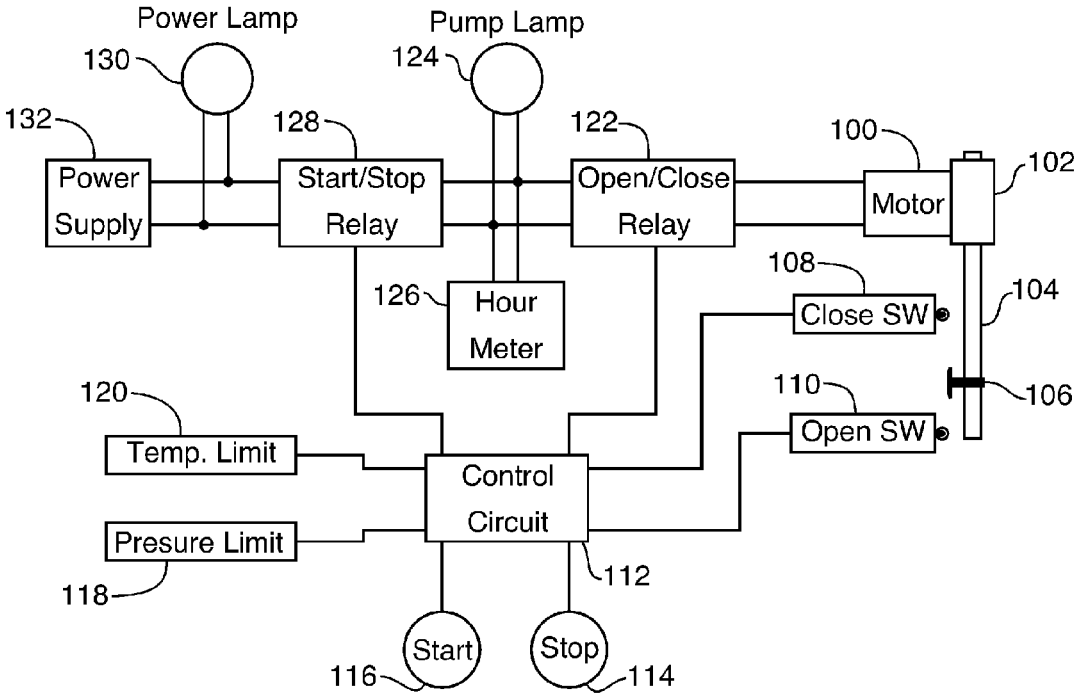
FIG. 17 is a functional schematic diagram a reciprocating air pump according to an illustrative embodiment of the present invention.

FIG. 17 is a functional schematic diagram a reciprocating air pump according to an illustrative embodiment of the present invention. In the illustrative embodiment, a DC motor 100 drives a geared rack 104 through a pinion gear drive 102. The polarity of the electric current driving the motor 100 controls the rotation of the motor 100, and therefore the direction in which the geared rack moves, which are called the "open" and "close" directions of the pumping action. Thus the open/close relay 122 severs to toggle the polarity of the electric current to control the direction of the motor 100 and the geared rack 104. An engagement member 106 is fixed with respect to the linear motion of the geared rack, and is aligned to engage both the close switch 108 and the open switch 110. Both of these switches are eclectically coupled to a control circuit 112. Actuation of either switch 108, 110 inputs a corresponding actuation signal to control circuit 112, which then alternatingly reverses the polarity of the open/close relay 122. This control arrangement indices a reciprocating motion in the geared rack 104, provided the electric power continues to be present at the input of the open/close relay 122. Power control to the input of the open/close relay 112 is through start/stop relay 128, which is also controlled by control circuit 112. The start/stop relay receives input power from a power supply 132, which may be either a vehicle power supply adapter or a wall-transformer in the illustrative embodiment. Power lamp 130 illuminates to indicate that a power supply is connected. Pump lamp 124 illuminates when power is being provided to the open/close relay 122. An electric hour meter 126 accumulates time so long as power is supplied to the open/close relay. The start/stop relay 128 is controlled by control circuit 112. The start/stop relay is energized with the start actuator 116 is pressed, and deenergized when the stop actuator 114 is pressed. In addition, the control circuit 112 deenergizes the start/stop relay 128 is a temperature limit is detected by temperature switch 120 or is a pressure limit is detected by pressure switch 118.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A reciprocating air pump apparatus, comprising:

a frame;

a pump for compressing air through a series of linear close-strokes and open-strokes performed between a first portion that is fixed in position with respect to said frame and a reciprocating portion, and said pump having plural cylinders slideably and sealably engaged therein and arranged as multiple-chambers defining multiple-stages, and thereby enabling said series of close-strokes and open-strokes to compress air;

a manifold, having an air inlet cavity with an inlet vent disposed on the exterior of said manifold, and having a compressed air outlet cavity formed therein with an outlet vent disposed on the exterior of said manifold;

an outlet valve body disposed between said first portion of said pump and said manifold, and threadably engaged with said manifold, and having an outlet valve therein, which is pneumatically coupled to direct high-pressure compressed air into said outlet cavity, and having an inlet port formed therethrough to pneumatically couple inlet air from said inlet cavity, and wherein said inlet cavity and said air port are pneumatically coupled by an annular cavity defined between said manifold and said outlet valve body when threadably engaged together, and wherein said annular cavity is disposed about said outlet valve;

a reciprocating linear drive having an electric motor, said drive fixed to said frame to deliver linear force to said reciprocating portion of said pump, and a control system coupled to said electric motor and operable to sequentially alternate the direction of force of said reciprocating linear drive, thereby enabling reciprocating application of linear force to said reciprocating portion.

2. The reciprocating air pump of claim 1, and wherein:

said inlet cavity and said air port is arranged in thermally conductive proximity to said outlet valve body, thereby enabling transfer of heat from compressed air output from the reciprocating air pump to ambient air drawn into said reciprocating air pump.

3. The reciprocating air pump of claim 1, further comprising:

an inlet air filter coupled to said inlet vent for filtering ambient air prior to entering the reciprocating air pump.

4. The reciprocal air pump of claim 1, and wherein:

said manifold has cooling fins formed on the exterior surface thereof to facilitate heat transfer from said manifold to the ambient environment.

5. The reciprocating air pump of claim 1, and wherein:

said reciprocating linear drive includes a rack and pinion gear, that is driven by said electric motor.

6. The reciprocating air pump of claim 5, and wherein:

said electric motor is a gear motor terminated with said pinion gear.

7. The reciprocating air pump of claim 1, and wherein:

said control system further comprises a means for reversing polarity of electric current to said motor to sequentially alternate the direction of rotation thereof.

8. The reciprocating air pump of claim 1, further comprising:

at least a first position detector coupled to said control system, and aligned to detect the position of said reciprocal portion.

9. The reciprocating air pump of claim 1, and wherein said pump is configured for a predetermined length of stroke between a fully closed position and a fully open position, and further comprising:

a first position detector coupled to said control system and aligned to indicate that said reciprocal portion is at said fully closed position;

a second position detector coupled to said control system and aligned to indicate that said reciprocal portion is at said fully open position, and wherein said control system is operable to reverse the direction of force applied by said reciprocating linear drive upon indication that said reciprocal portion has reached either of said fully open position or said fully closed position.

10. The reciprocating air pump of claim 9, and wherein:

said first position detector and said second position detector are limit switches.

11. The reciprocating air pump of claim 9, further comprising:

an engagement member fixed to said reciprocating portion and aligned to engage said first position detector and said second position detector.

12. The reciprocating air pump if claim 1, and wherein:

said reciprocating linear drive applies force to said reciprocating portion to induce a predetermined velocity of movement.

13. The reciprocating air pump of claim 12, and wherein:

said predetermined velocity is selected to correspond to a rate of operation of a manually driven air pump.

14. The reciprocating air pump of claim 12, and wherein:

said predetermined velocity is approximately one hundred twenty millimeters per second.

15. A reciprocating air pump apparatus, comprising:

a frame;

a pump for compressing air through a series of linear close-strokes and open-strokes performed between a reciprocating portion and a fixed portion that is fixed in position with respect to said frame, and wherein, (a) said reciprocating portion having a driven end and a first engagement end, and further including;

an outer cylinder having a closed cap at the driven end and a seal assembly at the first engagement end;

a piston rod, co-axially disposed within said outer cylinder, and fixed to said closed cap at the driven end, and having a piston fixed to the first engagement end, said piston having a piston valve; and (b) said fixed portion having a fixed end and a second engagement end, and further including;

a manifold at the fixed end, having an ambient air inlet cavity with and inlet vent, and a compressed air outlet cavity with an outlet vent, formed therein;

an outlet valve body threadably engaged with said manifold having an outlet valve therein, which is pneumatically coupled to said outlet cavity, and having an inlet port formed therethrough to pneumatically couple inlet air from said inlet cavity, and wherein said inlet cavity and said air port are pneumatically coupled by an annular cavity defined between said manifold and said outlet valve body when threadably engaged together, and wherein said annular cavity is disposed about said outlet valve;

a middle cylinder coupled to said outlet valve body at the fixed end and coupled to a transfer valve body at the second engagement end;

an inner cylinder coaxially disposed within said middle cylinder, and coupled to said outlet valve body at the fixed end and coupled to said transfer valve body at the second engagement end, and wherein said middle cylinder and said inner cylinder form an inlet annular chamber therebetween, which is bounded by said inlet valve body and said transfer valve body, said inlet annular chamber pneumatically coupled to said inlet port, and wherein (c) the first engagement end of said reciprocating portion slideably engages the second engagement end of said fixed portion, enabling the sequence of close-strokes and open-strokes, and wherein said outer cylinder, said middle cylinder, said inner cylinder and said piston rod are coaxially arranged in respective order of decreasing diameters, and wherein said transfer valve body sealably engages said piston rod and sealably engages the interior surface of said outer cylinder, thereby defining a first annular chamber bounded by said transfer valve body and said closed cap, and wherein said transfer valve body further includes an inlet valve disposed to direct the flow of air from said inlet air chamber into said first annular chamber on the open-stroke, and wherein said seal assembly sealably engages the exterior surface of said middle cylinder, and thereby defines a second annular chamber bounded by said seal assembly and said transfer valve body, and wherein said transfer valve body further includes a transfer valve disposed to direct the flow of air from said first annular chamber to said second annular chamber on the close-stroke, and wherein said piston sealably engages the interior of said inner cylinder and thereby defines a rod chamber bounded by said piston and said transfer valve body, and further defines a piston chamber bounded by said piston and said outlet valve body, and wherein said transfer valve body further includes a transfer port disposed to allow air to flow from said second annular chamber into said piston rod chamber on the open-stroke, and wherein said piston valve directs the flow of air from said rod chamber to said piston chamber on the open-stroke, and wherein said outlet valve directs air the flow from said piston chamber to said outlet cavity on the close-stroke;

a reciprocating linear drive having an electric motor, said drive fixed to said frame to deliver linear force to the driven end of said reciprocating portion of said pump, and a control system coupled to said electric motor and operable to sequentially alternate the direction of force of said reciprocating linear drive, thereby enabling reciprocating movement of said reciprocating linear drive along a predetermined length of stroke between a fully closed position and a fully open position.

16. The reciprocating air pump of claim 15, and wherein:

said reciprocating linear drive includes a rack and pinion gear, that is driven by said electric motor, and wherein said electric motor is a gear motor terminated with said pinion gear, and wherein said control system further comprises a means for reversing polarity of electric current to said motor to sequentially alternate the direction of rotation thereof.

17. The reciprocating air pump of claim 15, and wherein said pump is configured for a predetermined length of stroke between a fully closed position and a fully open position, and further comprising:

an engagement member fixed to said reciprocating portion;

a limit switch coupled to said control system and aligned to engage said engagement member to indicate that said reciprocal portion is at said fully closed position;

a second limit switch coupled to said control system and aligned to engage said engagement member to indicate that said reciprocal portion is at said fully open position, and wherein said control system is operable to reverse the direction of force applied by said reciprocating linear drive upon indication that said reciprocal portion has reached either of said fully open position or said fully closed position.

18. The reciprocating air pump if claim 15, and wherein:

said reciprocating drive applies force to said reciprocating portion to induce a predetermined velocity of movement that is selected to correspond to a rate of operation of a manually driven air pump.

* * * * *